US005924492A

United States Patent [19]

Kikuchi et al.

[11] Patent Number: 5,924,492

[45] Date of Patent: Jul. 20, 1999

[54] SPRINKLER HEAD ASSEMBLY

[75] Inventors: Tetsuro Kikuchi; Fukuji Obara; Takatoshi Chiba, all of Iwate-ken, Japan

[73] Assignee: Senju Sprinkler Company Limited, Tokyo, Japan

[21] Appl. No.: 08/886,971

[22] Filed: Jul. 2, 1997

[30] Foreign Application Priority Data

Jul. 2, 1996 [JP] Japan ..... 8-189915
Mar. 28, 1997 [JP] Japan ..... 9-092789

[51] Int. Cl.[6] ..... A62C 37/08

[52] U.S. Cl. ..... 169/37; 169/42; 137/72

[58] Field of Search ..... 169/40, 41, 90, 169/37; 137/468, 79, 72

[56] References Cited

U.S. PATENT DOCUMENTS

| | | | |
|---|---|---|---|
| 295,022 | 8/1884 | Boyer | 137/72 |
| 1,042,541 | 10/1912 | Finnegan | 169/41 |
| 1,891,183 | 12/1932 | Rowley | 137/72 |
| 1,982,078 | 11/1934 | Spencer | 137/468 |
| 2,989,283 | 6/1961 | Klinger . | |
| 3,260,458 | 7/1966 | Klinefelter | 137/468 |
| 3,366,136 | 1/1968 | Burton | 137/468 |
| 3,716,103 | 2/1973 | Tanaka et al. | 169/42 |
| 3,768,514 | 10/1973 | Goto | 137/609 |
| 3,842,853 | 10/1974 | Kelly et al. | 137/92 |
| 3,954,666 | 5/1976 | Baker | 137/468 |
| 4,508,175 | 4/1985 | Pieczykolan . | |
| 4,618,002 | 10/1986 | Mears . | |
| 4,651,832 | 3/1987 | Kubo | 169/42 |
| 4,715,447 | 12/1987 | Johnson . | |

FOREIGN PATENT DOCUMENTS

| | | | |
|---|---|---|---|
| 52-55295 | 5/1977 | Japan | 169/90 |
| 52-55297 | 5/1977 | Japan | 169/90 |

*Primary Examiner*—Kevin Weldon
*Attorney, Agent, or Firm*—Wenderoth, Lind & Ponack, L.L.P.

[57] ABSTRACT

A sprinkler head includes a nozzle through which water is discharged to extinguish fire. The nozzle is normally held in a closed position. The nozzle is opened in the event of fire. A leaf spring is provided to hold the nozzle in its closed position and permit the nozzle to open. The leaf spring is deformed both in the axial direction of the sprinkler head and in a direction at right angles to the axial direction when an axial force is applied. Furthermore, the leaf spring and is resiliently returned to its original shape when the axial force is released.

11 Claims, 10 Drawing Sheets

SPRINKLER HEAD ASSEMBLY

BACKGROUND OF THE INVENTION

The present invention relates to a sprinkler head adapted to spread water to extinguish fire.

A sprinkler head includes a valve element sealingly held against a valve seat by a thermally responsive assembly. In the event of fire, the thermally responsive assembly collapses at an elevated temperature. This causes the valve element to drop and separate from the valve seat whereby water is sprayed. The thermally responsive assembly is devised so that an easily fusible alloy will melt in the event of fire to thereby cause structural parts of the thermally responsive assembly, supported by the fusible alloy, to be displaced to enable complete disruption of the thermally responsive assembly.

The sprinkler head is typically mounted on the ceiling of a building during construction and will not be removed until the building is intentionally destroyed due to age, except that the building suffers from fire. The valve seat is thus subjected to pressure for a prolonged period of time. Normally, water having a pressure of approximately 10 kgf/cm$^2$ is filled in a pipe to which the sprinkler head is connected. To withstand such a high water pressure, the valve element is pressed against the valve seat with a significant amount of force to provide a tight seal and prevent water leakage. This force also acts on the thermally responsive assembly. As the thermally responsive assembly is of an intricate construction as previously described, its structural parts are prone to deformation or displacement due to material creep upon extended application of substantial force. As this occurs, a force under which the valve element is pressed against decreases, resulting in water leakage.

To this end, the sprinkler head includes means for reducing the extent of a force applied from the valve element to the thermally responsive assembly. This means utilizes the principle of a lever. That is, the amount of a force times the distance between the load and the fulcrum is equal to the amount of a force times the distance between the effort and the fulcrum. The greater the distance between the fulcrum and the load, the less force needs to be applied to the load.

A conventional sprinkler head employs a pair of bent levers as disclosed in Japanese patent publication No. 58-36985. Each of the levers is made of a flat plate and has a fishhook-like section. A substantial force is applied to a bent portion or apex of the lever which serves as the effort of the lever. The lever has a hook or short leg, the end of which serves as the fulcrum. The lever also has a long leg, the end of which serves as the load. The distance between the fulcrum and the load is greater than the distance between the effort and the fulcrum. Accordingly, only a small force is applied to the end of the long leg or a thermally responsive assembly.

To press a valve element, a substantial force is applied equally to the apexes of the two levers.

If a person walks with a long object or a small child throws an object in a room or hallway where a sprinkler head is installed, such objects may accidentally contact with the sprinkler head. It is likely that such contact of objects with the sprinkler head (referred to as "external force") will cause displacement or breakage of the thermally responsive assembly. As this happens, a force under which the valve element is pressed against decreases. This results in water leakage. In some cases, the valve element may be completely disengaged from the valve seat to thereby cause undesirable water discharge or explosion.

The valve element should be opened to discharge water only in the event of a fire. The water discharge inevitably dampens official machines, valuable documents, furniture, carpet or other interior objects. However, it will be a tremendous loss if this occurs due to inadvertent water leakage or explosion from the sprinkler head rather than actual fire.

In the prior sprinkler head, the thermally responsive assembly is likely to malfunction upon application of even a small amount of external force and create water damage. Full collapse of the thermally responsive assembly takes place when the fusible alloy melts to allow the levers to move. This arrangement also results in an increase in the number of necessary parts and the production cost, and requires substantial effort to fabricate the thermally responsive assembly.

The present invention provides a reliable and economical sprinkler head which is capable of holding a thermally responsive unit against displacement or breakage which may occur when external forces are applied, and which enables a reduction in the number of parts required to fabricate the thermally responsive unit and thus, the production cost.

SUMMARY OF THE INVENTION

After extensive research, the inventors have found that the prior sprinkler head is susceptible to external forces since a pair of separate levers are employed. If, for example, an external force is exerted on one of the two levers, the levers are easily displaced or disengaged. Also, the thermally responsive assembly requires a large number of parts since two levers are employed, and quite a few parts are necessary to hold these levers.

To this end, the inventors have made up the invention wherein an integral unit, rather than separate levers, is employed to increase the strength of the entire assembly. The use of such an integral unit brings about a reduction in the number of required parts to hold the same.

The present invention provides a sprinkler head comprising a nozzle adapted to permit the flow of water therethrough to extinguish fire. The sprinkler head is normally held in a closed position and is caused to be opened in the event of fire, and includes a device for holding the nozzle in its closed position and permitting the nozzle to open. This device includes a leaf spring deformable in the axial direction of the sprinkler head and in a direction at right angles to the axial direction of the sprinkler head when an axial force is applied thereto. In turn, the leaf spring is resiliently returned to its original shape when the axial force is released.

DETAILED DESCRIPTION OF THE INVENTION

Figure 10:
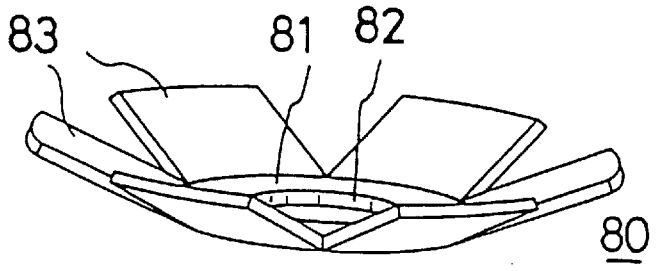
FIG. 10 is a perspective view of a leaf spring for use in the sprinkler head of the present invention.

FIGS. 10 to 14 illustrate leaf springs for use in the present invention. A leaf spring 80 shown in FIG. 10 is in the form of a dish and has a bottom 81 in which a central opening 82 is defined. A plurality of locking elements 83 extend radially outwardly from the circumference of the bottom 81. The locking elements 83 have outer ends which are biased in an inward direction to decrease the outer diameter of the leaf spring. When an axial load is exerted to deform the leaf spring 80, a part of the leaf spring which extends at right angles to the axis of the leaf spring is brought into engagement with a structural part of a sprinkler head to hold a nozzle in a closed position. That is, the outer ends of the locking elements have such a size as to be engageable with the structural part of the sprinkler head when the leaf spring becomes flat against its bias. The leaf spring has a diameter less than that of the structural part when the outer ends of the locking elements are bent inward under the bias of the leaf spring.

Figure 11:
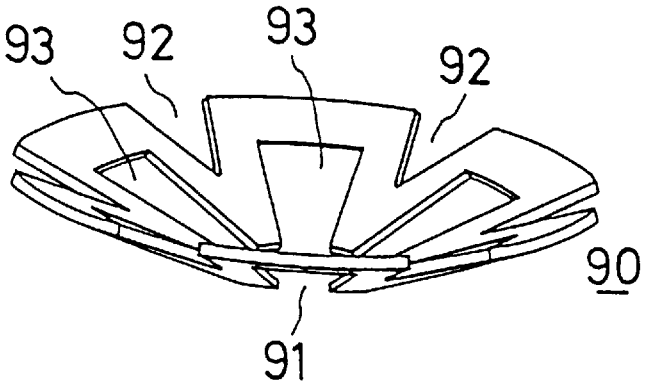
FIG. 11 is a perspective view of a modified leaf spring for use in the sprinkler head of the present invention.

A leaf spring 90 shown in FIG. 11 has a central opening 91. The leaf spring has a frustoconical shape and includes a plurality of V-shaped outer recesses 92 and a plurality of U-shaped inner recesses 93 alternately arranged along the circumference of the leaf spring. The outer ends of the leaf spring are biased inward under the bias of the leaf spring. When the leaf spring 90 becomes flat against its bias, the outer diameter of the leaf spring increases whereas the diameter of the opening decreases.

Figure 12:
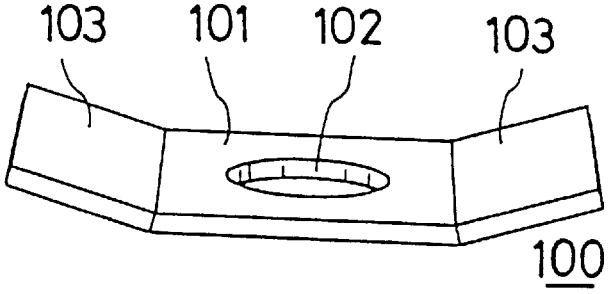
FIG. 12 is a perspective view of another modified leaf spring for use in the sprinkle head of the present invention.

A leaf spring 100 shown in FIG. 12 is rectangular in shape and has a bottom 101 at its center. An opening 102 is defined centrally in the bottom 101. A pair of locking elements 103, 103 extend outwardly from opposite ends of the bottom 101. The locking elements are normally bent inwardly from the bottom. The locking elements, when mounted to the sprinkler head, are made flat and are subject to an inward bias.

Figure 13:
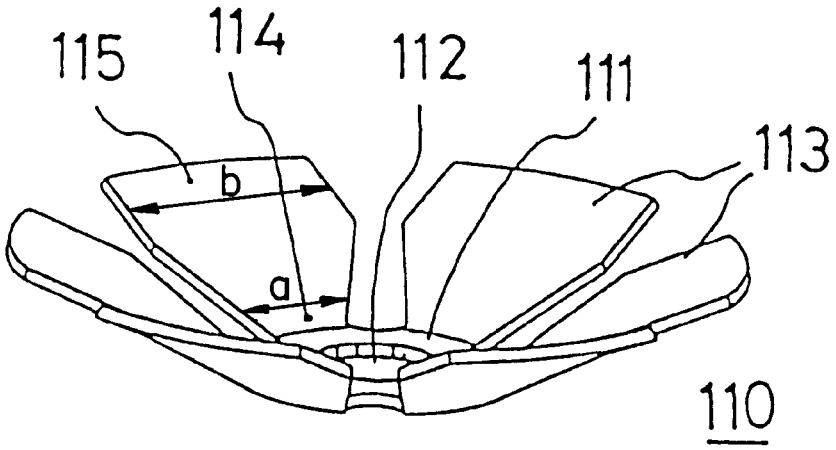
FIG. 13 is a perspective view of yet another modified leaf spring for use in the sprinkler head of the present invention.

A leaf spring 110 shown in FIG. 13 has a bottom 111 in which a central opening 112 is defined, and a plurality of locking elements 113 extending radially from the circumference of the bottom 111. Slits are formed between adjacent locking elements. Each of the slits is narrower toward its bottom and diverges toward its outer portion. Thus, a portion 114 of the locking elements adjacent to the bottom 111 has a width a which is less than a width b of an outer portion 115. Provided that the leaf spring 110 has an identical thickness throughout its length, the outer portion 115 has a greater mechanical strength than the portion 114. The portion 114 has a spring force less than that of the outer portion 115.

Figure 14:
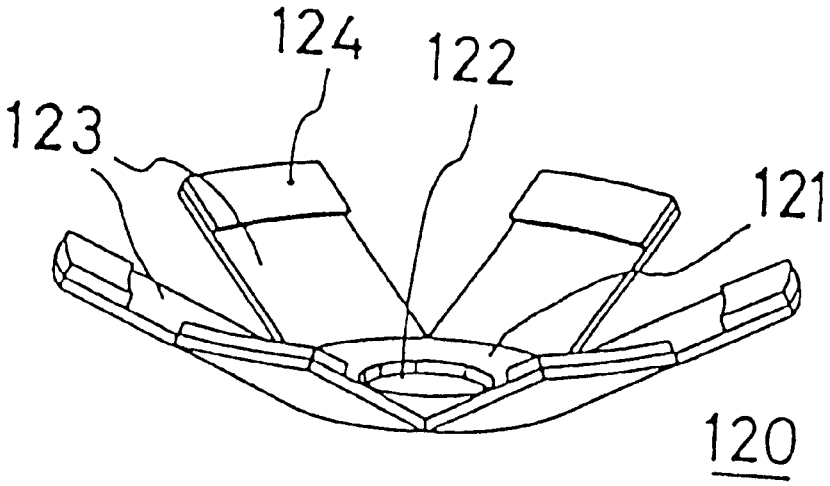
FIG. 14 is a perspective view of still another modified leaf spring for use in the sprinkle head of the present invention.

A leaf spring 120 shown in FIG. 14 has a bottom 121 in which a central opening 122 is defined, and a plurality of locking elements 123 extending radially from the circumference of the bottom. The leaf spring has a shape identical to that of the leaf spring 80 shown in FIG. 10. More specifically, a portion of the leaf spring 120 adjacent to its bottom has substantially the same width as its outer portion. Additionally, reinforcing members 124 are attached to the outer portion of the leaf spring 120. Thus, the outer portion of the leaf spring 120 has a greater thickness or mechanical strength than the remaining portion of the leaf spring 120.

By increasing the mechanical strength of the outer portion of each of the leaf springs shown in FIGS. 13 and 14, the outer portions of the locking elements can be engaged with the structural part of the sprinkler head with a higher level of reliability. It will be noted that a force by which a valve element of the sprinkler head is held against a valve seat should be strong enough to prevent leakage of water. Where the valve element is directly engaged with the other part or engagement portion of the sprinkler head which will be described later, a substantial degree of force is exerted on the outer portion of the leaf spring. To withstand such a force, it is necessary to increase the mechanical strength of the outer portions of the leaf springs as shown in FIGS. 13 and 14.

Where a force is applied from the leaf spring directly to a thermally responsive unit, it is necessary to not only increase the mechanical strength of the outer portion of the leaf spring, but also decrease the extent of a force applied to the thermally responsive unit for better reliability of the sprinkler head. This is because an easily fusible alloy, a glass valve or other thermally responsive elements are prone to deformation or breakage upon application of a substantial force over time. The narrower the width of a bottom portion of the leaf spring, the smaller a spring force will be as a shown in FIG. 13.

The locking elements of the leaf springs shown in FIGS. 10 to 14 are bent inward when no load is exerted. When an axial or vertical force is applied to the bottom, the leaf spring becomes flat whereby the outer ends of the locking elements provide an inward bias. Conversely, a leaf spring used in the sprinkler head of the present invention may be substantially flat when no load is exerted. Upon application of an axial force, the outer ends of the locking elements may provide an outward bias.

According to the present invention, the sprinkler head includes a single leaf spring by which a nozzle is closed and opened. Alternatively, a plurality of leaf springs may be employed from a mechanical or structural point of view.

According to the present invention, the sprinkler head includes structural parts engageable with the leaf spring by which a valve element is held. Such structural parts include, but are not limited to, a nozzle, a guide post, a frame, and a cover.

According to the present invention, means for restricting springback of the leaf spring may include an easily fusible alloy which melts at a predetermined temperature, a shape memory alloy which is deformable at a predetermined temperature, and a thermally responsive element such as a glass valve which is collapsible at a predetermined temperature.

The present invention relates to a sprinkler head wherein a valve element is sealingly held against a valve seat. The present invention is applicable to a multi-type sprinkler head wherein a cup-shaped cover is formed with a plurality of apertures, a frame yoke-type sprinkler head wherein a deflector depends from the lower part of a body, and a flush-type sprinkler head wherein a deflector is normally contained within the sprinkler head and is caused to drop by a predetermined distance in the event of fire.

Figure 1:
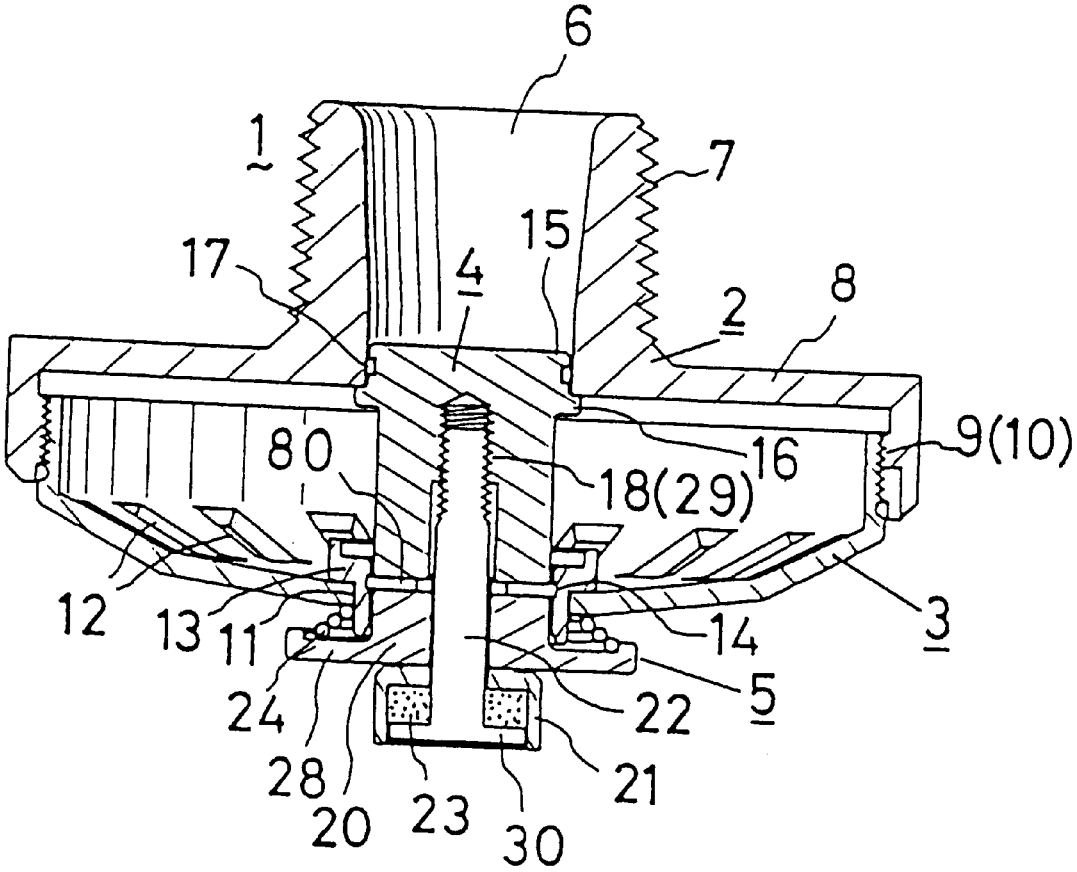
FIG. 1 is a front view, in section, of a multi-type sprinkler head according to a first embodiment of the present invention.
Figure 2:
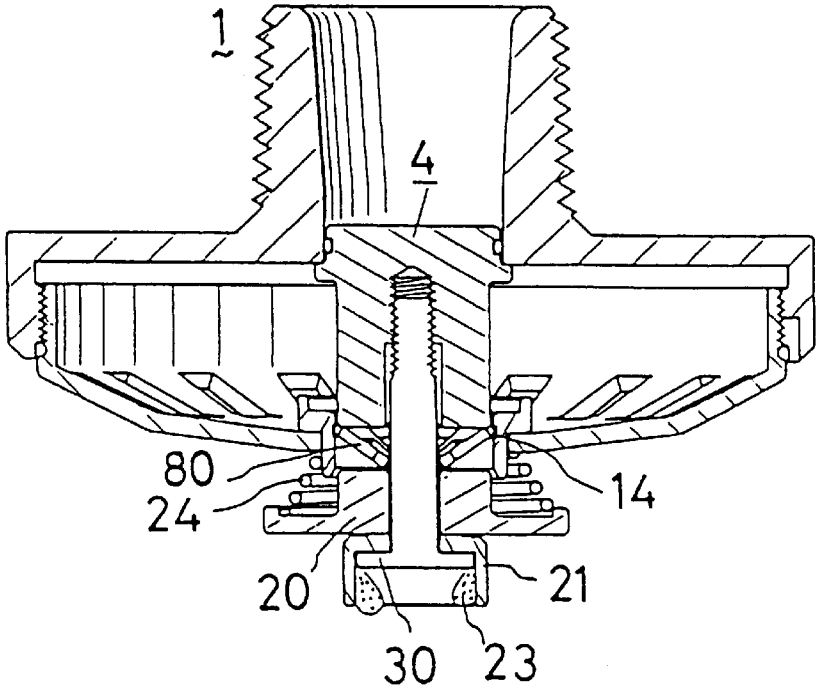
FIG. 2 is a front view, in section, of the multi-type sprinkler head in the intermediate stage of operation.
Figure 3:
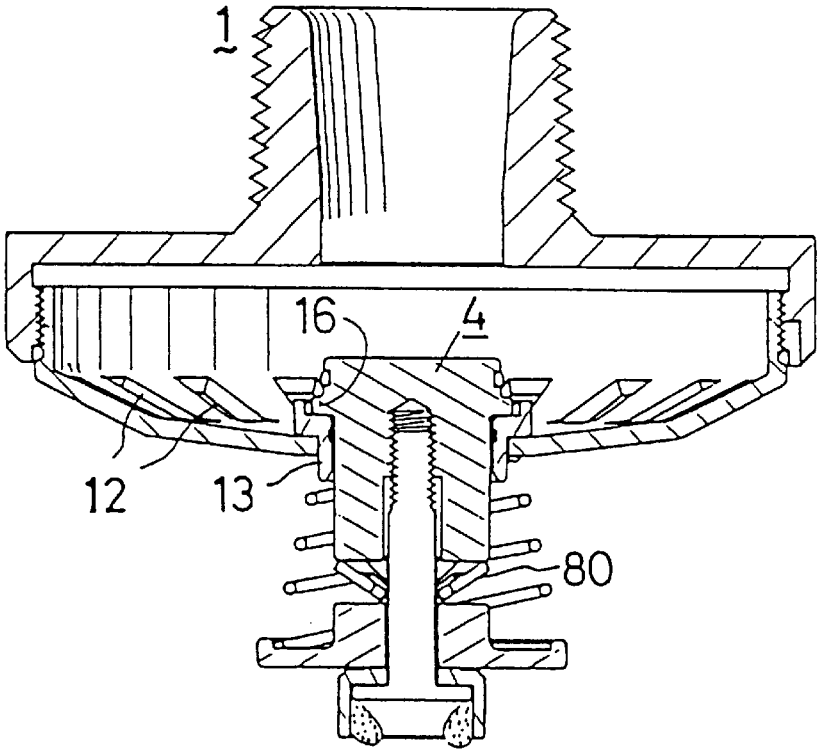
FIG. 3 is a front view, in section, of the multi-type sprinkler head in the final stage of operation.
Figure 4:
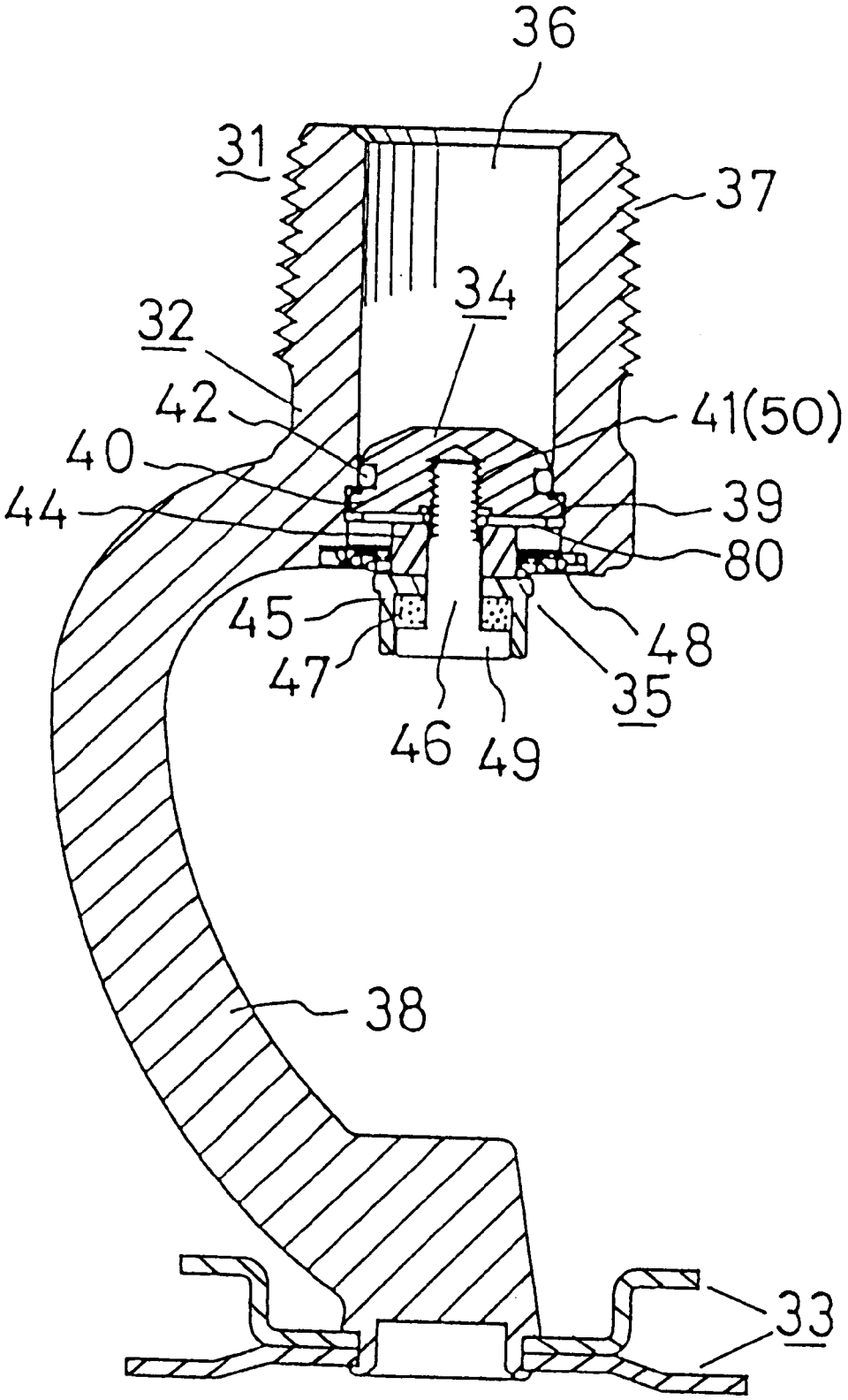
FIG. 4 is a front view, in section, of a frame yoke-type sprinkler head according to a second embodiment of the present invention.
Figure 5:
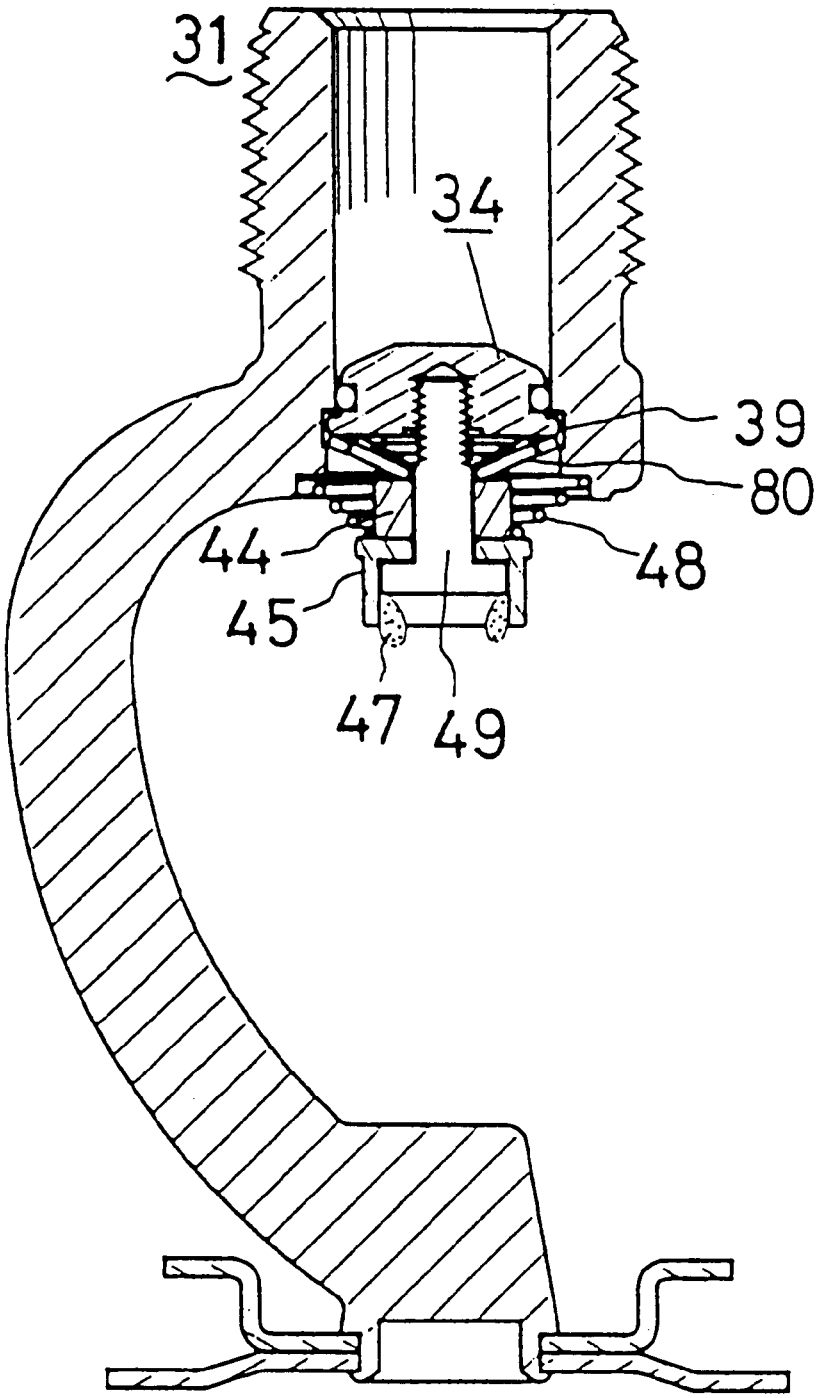
FIG. 5 is a front view, in section, of the frame yoke-type sprinkler head of the second embodiment in the intermediate stage of operation.
Figure 6:
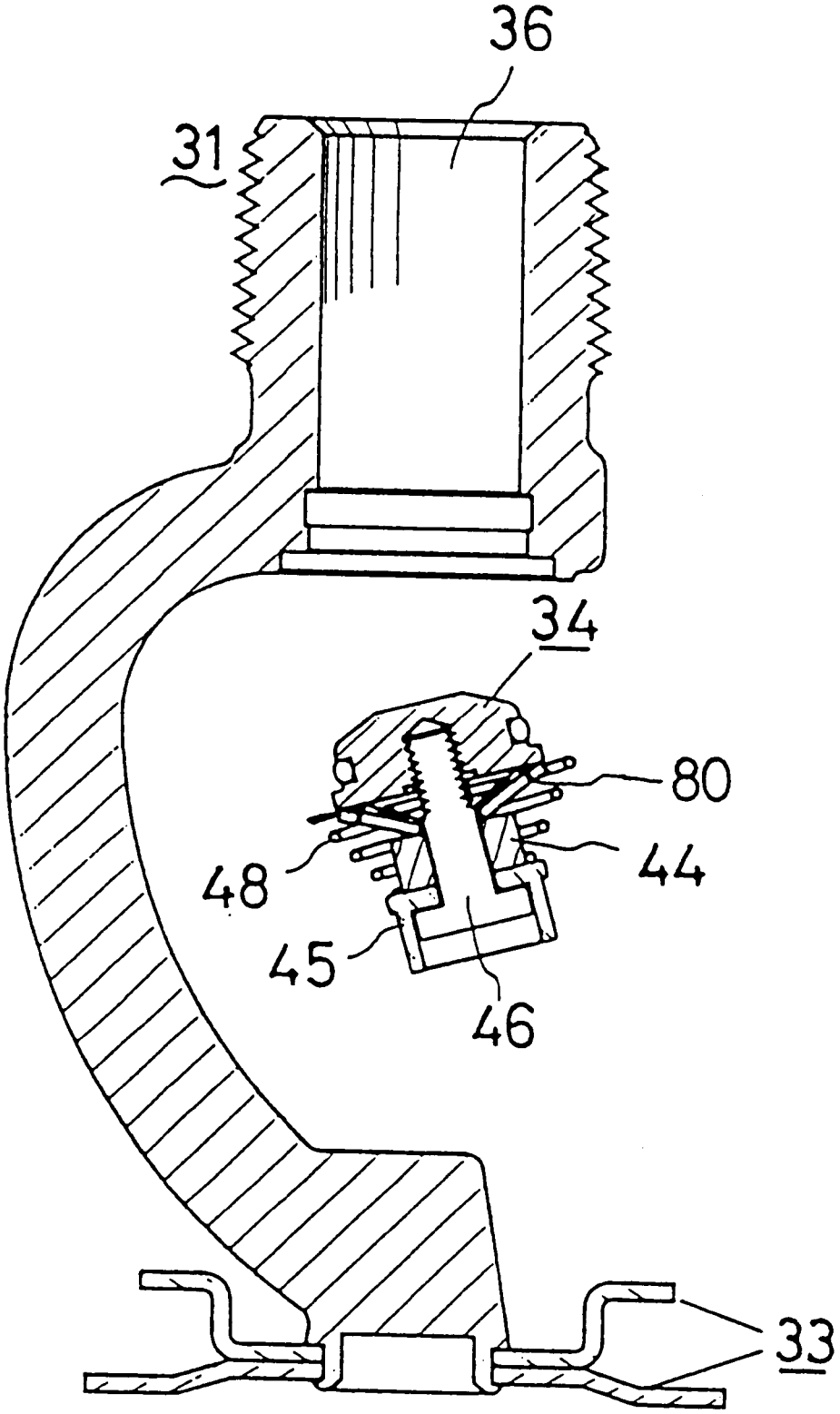
FIG. 6 is a front view, in section, of the frame yoke-type sprinkler head of the second embodiment in the final stage of operation.
Figure 7:
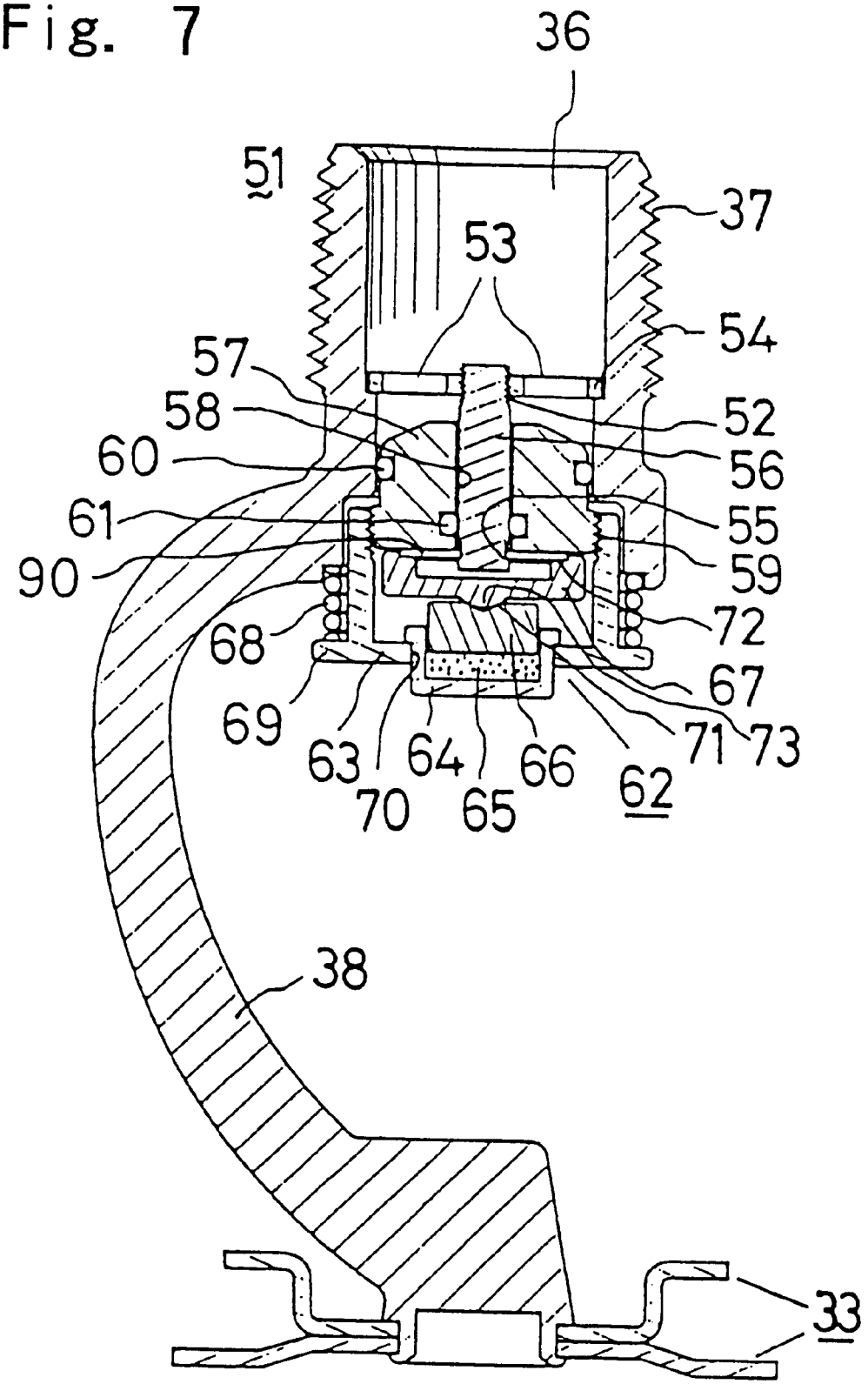
FIG. 7 is a front view, in section, of a frame yoke-type sprinkler head according to a third embodiment of the present invention.
Figure 8:
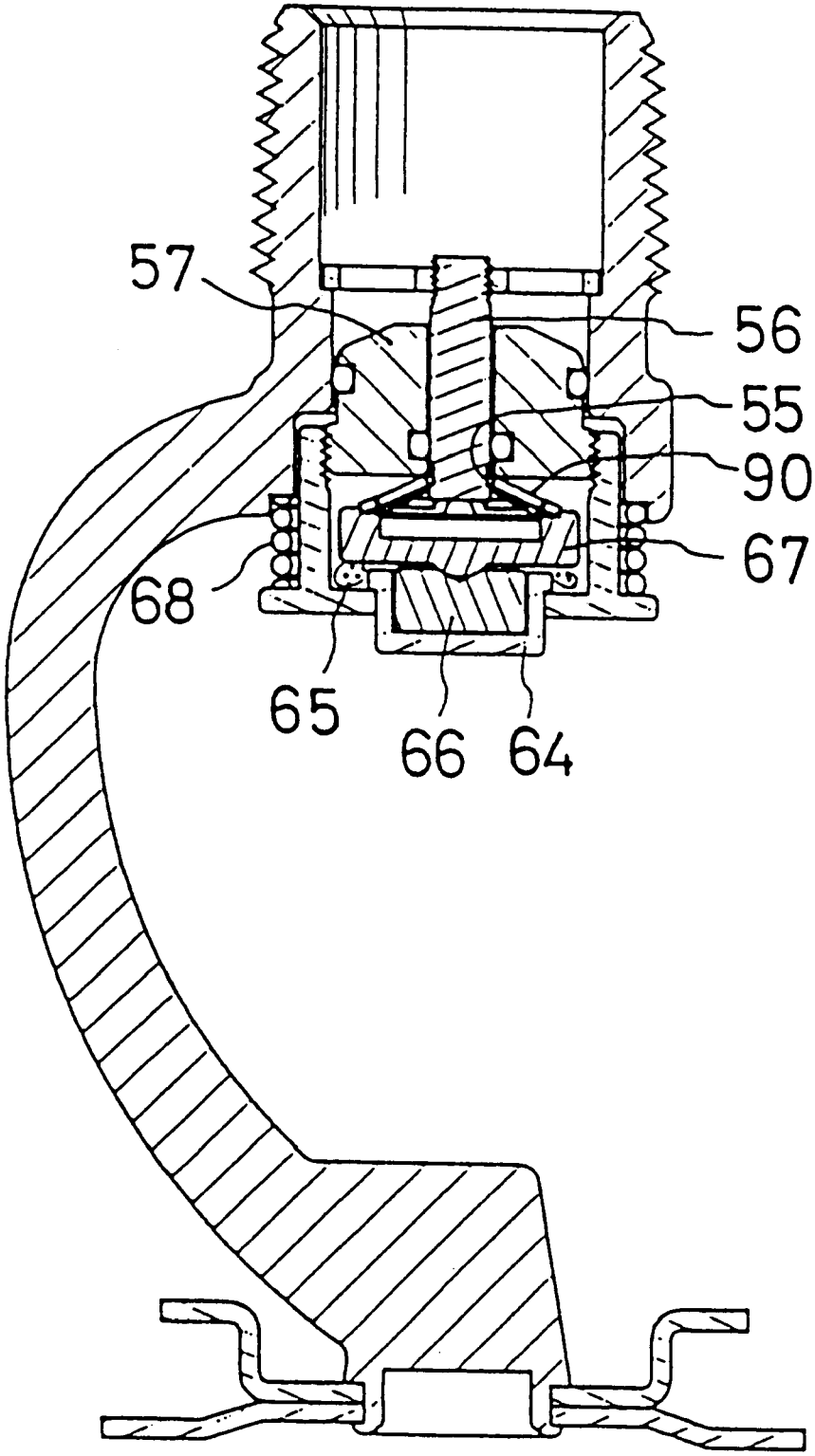
FIG. 8 is a front view, in section, of the frame yoke-type sprinkler head of the second embodiment in the intermediate stage of operation.
Figure 9:
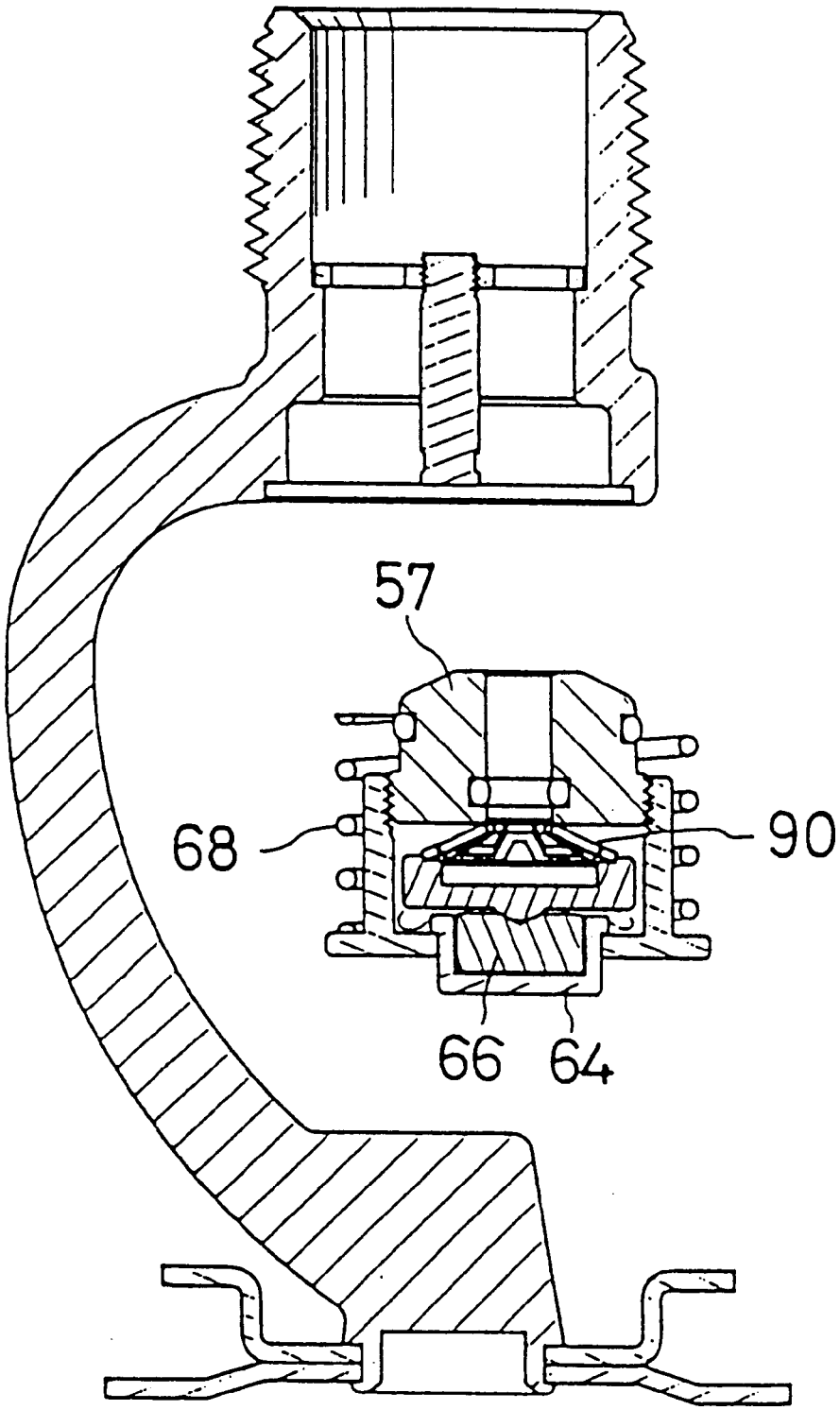
FIG. 9 is a front view, in section, of the frame yoke-type sprinkler head of the second embodiment in the final stage of operation.

The present invention will now be described with reference to the accompanying drawings. FIG. 1 is a front sectional view of a multi-type sprinkler head according to a first embodiment of the present invention. FIG. 2 is a front sectional view of the multi-type sprinkler head in its intermediate stage of operation. FIG. 3 is a front sectional view of the multi-type sprinkle head in its final stage of operation. FIG. 4 is a front sectional view of a frame yoke-type sprinkler head according to a second embodiment of the present invention. FIG. 5 is a front sectional view of the frame-yoke type sprinkler head of the second embodiment in its intermediate stage of operation. FIG. 6 is a front sectional view of the frame yoke-type sprinkler head of the second embodiment in its final stage of operation. FIG. 7 is a front sectional view of a frame yoke-type sprinkler head according to a third embodiment of the present invention. FIG. 8 is a front sectional view of the frame-yoke type sprinkler head of the third embodiment in its intermediate stage of operation. FIG. 9 is a front sectional view of the frame yoke-type sprinkler head of the third embodiment in its final stage of operation.

Referring now to FIGS. 1 to 3, there is illustrated a multi-type sprinkler head assembled according to a first embodiment of the present invention.

A multi-type sprinkler head 1 includes a body 2, a cover 3, a valve element 4 and a thermally responsive unit 5.

The body 2 has a central nozzle 6 and includes male threads 7 to which a pipe, not shown, is mounted. A flange 8 extends around the lower part of the body 2 and has a larger diameter than the nozzle. The flange 8 has a depending wall, the inner surface of which is formed with female threads 9.

The cover 3 is in the form of a bowl. The upper part of the cover 3 is formed with male threads 10 which are threadably engaged with the female threads 9 of the flange 8. The cover 3 has a central opening 11. A plurality of water outlets 12 are defined around the central opening 11. A cylindrical guide post 13 is fitted in the central opening 11 of the cover 3. The guide post 13 has a large diameter upper portion and a small diameter lower portion. A groove 14 is formed in the small diameter portion.

The valve element 4 is cylindrical in shape and includes an upper part or insert portion 15 inserted into the lower portion of the nozzle 6, and a flange 16 formed below the insert portion 15 and having a larger diameter than the nozzle. A groove is defined in the insert portion 15 to receive an O-ring 17. The O-ring 17 permits sliding movement of the valve element 4 within the nozzle and holds the valve element in a water-tight manner. The valve body 4 has a length so that with the insert portion 15 inserted into the nozzle 6, and the flange held against the lower surface of the nozzle, the lower portion of the valve body extends slightly into the small diameter portion of the guide post 13. A portion of the valve body below the flange 16 has a diameter so that the valve body can readily be slid within the guide post 13. Female threads 18 are formed centrally in the lower surface of the valve body.

The thermally responsive unit 5 generally includes the leaf spring 80, a plug 20, a cylinder 21, a plunger 22, an easily fusible alloy 23, and a helical spring 24.

The leaf spring used in the first embodiment of the sprinkler head is in the form of a dish as shown in FIG. 10. The locking elements 83 are bent inward when no load is exerted. When an axial force is applied, the leaf spring becomes flat so that the outer ends of the locking elements provide an inward bias.

The plug 20 is cylindrical in shape and includes a lower flange 28, and a central hole. The plug 20 has a diameter substantially identical to that of the lower portion of the valve body 4. Normally, the leaf spring 80 is pressed between the upper surface of the plug 20 and the lower surface of the valve body 4 and is held in a flat state. By this arrangement, the outer diameter of the leaf spring is greater than that of each of the valve element 4 and the plug 20. The leaf spring thus projects slightly from the valve body and the plug. A part of the leaf spring which projects from the valve body and the plug is received in the groove 14 of the guide post 13.

The cylinder 21 is in the form of a cup and has a bottom in which an opening is formed. This opening has substantially the same diameter as the central hole of the plug 20. The cylinder 21 is attached to the lower surface of the plug 20 with the opening aligned with the central hole.

The plunger 22 is in the form of a bolt and has male threads 29 at its one end and a head 30 at the other end. The male threads 29 of the plunger 22 are threadably engaged with the female threads 18 of the valve body 4. The head 30 is inserted into and located within the cylinder 21.

The easily fusible alloy 23 is filled in the cylinder 21 and is located between the head 30 of the plunger 22 and the bottom of the cylinder 21.

The helical spring 24 is compressed between the flange 28 of the plug 20 and the cover 3. Normally, the helical spring 24 urges the plug 20 in a downward direction. Since the plug 20 is urged downward under the influence of the helical spring 24 and the leaf spring 80, the easily fusible alloy 23 is pressed between the head 30 of the plunger 22 fixed to the valve body 4 and the cylinder 21.

Operation of the first embodiment of the multi-type sprinkler head is as follows. In the event of fire, the fusible alloy 23 is exposed to an excessively elevated temperature within the cylinder 21. The fusible alloy 23 will melt at a predetermined temperature (typically, 72° C. or 96° C.). As pressure is applied from the head 30 of the plunger 22, the fusible alloy 23, when melted, is caused to escape between the cylinder 21 and the head 30. The head 30 is then moved toward the bottom of the cylinder 21 to permit downward movement of the plug 20 under the action of the helical spring 24 and the leaf spring 80. As a result, a clearance is formed between the valve body 4 and the plug 20. This clearance allows the locking elements 83 of the leaf spring 80 to move inward and separate from the groove 14 of the guide post 13.

The valve body 4 is normally pressed by water within the pipe. Also, the plug 20 is pressed down under the action of the helical spring 24. As such, the insert portion 15 of the valve body 4 is separated from the nozzle 6 on disengagement of the leaf spring 80. Then, the valve body 4, the leaf spring 80, the plug 20, the cylinder 21, the plunger 22 and the helical spring 24 are moved down. This downward movement is stopped when the flange 16 of the valve body 4 is brought into engagement with the large diameter portion of the guide post 13.

When the valve body 4 is separated from the nozzle 6, water within the pipe is caused to flow out of the nozzle 6, impinges on the top of the valve body 4, and fills the cover 3. Thereafter, the water flows through the water outlets 12 and is discharged or sprayed to extinguish fire.

FIGS. 4 to 6 illustrate the second embodiment of the frame yoke-type sprinkler head.

A frame yoke-type sprinkler head 31 includes a body 32, deflectors 33, a valve element 34, and a thermally responsive unit 35.

The body 32 has a central nozzle 36. Male threads 37 are formed in the upper portion of the nozzle to mount a pipe, not shown. A curved frame yoke 38 extends from the lower end of the male threads 37. In a conventional frame yoke-type sprinkler head, a thermally responsive assembly is disposed between the lower end of a nozzle and the lower ends of frame yokes. To increase the mechanical strength, two thick frame yokes are required. As the frame yokes affect water discharge, it is preferable to minimize the number of and reduce the diameter of the frame yokes. The present invention eliminates the need to hold the thermally responsive unit between the lower end of the nozzle and the frame yokes and allows for the use of a single frame yoke. The frame yoke can also be thinner than the prior frame yokes. A groove 39 is formed in the lower portion of the nozzle 36.

Each of the deflectors 33 is in the form of a circular disc and has a plurality of vanes around its peripheral edge. Illustratively, two deflectors are attached to the lower end of the frame yoke 38.

The valve body 34 is cylindrical in shape and has an outer diameter slightly less than the inner diameter of the nozzle 36. A flange 40 extends around the lower end of the valve body 34. Also, female threads 41 are formed centrally within the bottom of the valve body 34. A groove is formed around the valve body substantially intermediate its length. An O-ring 42 is fitted in the groove and permits the valve body to slide within the nozzle in a water-tight manner.

The thermally responsive unit 35 generally includes the leaf spring 80, a plug 44, a cylinder 45, a plunger 46, an easily fusible alloy 47 and a helical spring 48.

The leaf spring used in the second embodiment of the frame yoke-type sprinkler head is identical to that used in the first embodiment of the multi-type sprinkler head. The leaf spring 80, when it becomes flat against its bias, has a size so that the outer ends of the locking elements are inserted into the groove 39. Also, the leaf spring 80 has a diameter less than that of the groove 39 when the outer ends of the locking elements are biased inward. Normally, the leaf spring 80 is pressed into a flat shape between the valve body 34 and the plug 44 and has an outer end fitted within the groove 39 of the nozzle 34.

The plug 44 is cylindrical in shape and has a diameter less than that of the valve body 34. The plug 44 has a central hole. The plug 44 cooperates with the valve body 34 to press the leaf spring 80 into a flat shape.

The cylinder 45 is in the form of a cup and has a central opening at its bottom. The cylinder is attached to the lower surface of the plug 44 with the opening aligned with the central hole of the plug 44.

The plunger 46 is in the form of a bolt and has male threads 50 at its one end and a head 49 at the other end. The male threads of the plunger 46 are threadably engaged with the female threads 41 of the valve body 34. The head 49 is located within the cylinder 45.

The easily fusible alloy 47 is filled in the cylinder 45 and compressed by the head 49 of the plunger 46.

The helical spring 48 is compressed between the lower end of the nozzle 36 and the cylinder 45 and is adapted to normally urge the cylinder in a downward direction. Although the valve body 34 is subjected to water pressure within the pipe and a downward bias by the helical spring 48, the valve body 34 is held in position within the nozzle since the leaf spring 80 is fitted in the groove 39 of the nozzle 36.

Reference will next be made to the operation of the second embodiment of the frame yoke-type sprinkler head.

In the event of fire, the fusible alloy 47 within the cylinder 45 melts and then, escapes from between the cylinder 45 and the head 49 of the plunger 46 as shown in FIG. 5. The plug 44 is separated from the valve body 34 as the leaf spring 80 provides an inward bias. The leaf spring 80 is then disengaged from the groove 39. Since there exists no means to hold the valve body 34 within the nozzle 36, the valve body 34, the leaf spring 80, the plug 44, the cylinder 45, the plunger 46, and the helical spring 48 all drop under the influence of water pressure within the pipe and the bias of the helical spring 48, as shown in FIG. 6. As the valve body 34 drops, water is discharged from the nozzle 36, impinges on the deflectors 33, and spreads, or is sprayed so as to extinguish the fire.

FIGS. 7 to 9 illustrate the third embodiment of a frame yoke-type sprinkler head.

Parts used in a frame yoke-type sprinkler head 51 according to the third embodiment which are similar to parts in earlier described embodiments are given like reference numerals and will not be described again.

An annular retainer 54 has central female threads 52 around which a plurality of ports 53 are defined. The annular retainer 54 is mounted to the intermediate portion of the nozzle 36. A slide rod 56 is threaded to the female threads 52 of the annular retainer 54 and has a groove 55 at its lower portion.

A valve body 57 has a central hole 58. Male threads 59 are formed in the lower portion of the valve body 57. Grooves are formed in the outer surface of the valve body 57 and the lower portion of the central hole to receive corresponding O-rings 60, 61.

The thermally responsive unit 62 generally includes a retainer 63, a cylinder 64, an easily fusible alloy 65, a plunger 66, a valve seat 67, a compression spring 68 and the leaf spring 90.

The leaf spring used in the third embodiment of the sprinkler head has a frustoconical shape as shown in FIG. 11. The diameter of the opening 91 is greater when no load is exerted than when load is exerted to make the leaf spring flat.

The retainer 63 is cylindrical in shape and has a closed bottom. A flange 69 extends around the lower end of the retainer. An opening 70 is defined centrally in the bottom of the retainer. The cylinder 64 is cylindrical in shape and has a closed bottom. The cylinder 64 is filled with the fusible alloy 65. A flange extends around the open top of the cylinder. The plunger 66 is cylindrical in shape. A conical recess 71 is formed centrally in the top of the plunger 66. The valve seat 67 is of a low profile and has a closed bottom. A step 72 is formed in the top of the valve seat 67. A semispherical projection 73 is formed in the bottom of the valve seat 67.

In the third embodiment of the frame yoke-type sprinkler head, the valve body 57 is inserted into the nozzle 36, and the slide rod 56 is inserted into the hole 58. At this time, the compression spring 68 is compressed between the flange 69 and the lower end of the nozzle so as to urge the retainer in a downward direction. The compression spring is seated on the flange 69 of the retainer 63. The cylinder 64 extends through the opening 70 of the retainer so that the flange of the cylinder is engaged with the opening 70. The plunger 66 is placed on the fusible alloy 65 which is filled in the cylinder 64. The projection 73 of the valve seat 67 is received in the recess 71 of the plunger. The retainer 63 is threaded to the male threads 59 of the valve body 57 with the leaf spring 90, shown in FIG. 11, placed in the step 72 of the valve seat 67. As the retainer 63 is threaded to the valve body 57, the leaf spring 90 becomes flat against its bias as shown in FIG. 7. As a result, the outer diameter of the leaf spring 90 increases whereas the inner diameter of the opening 91 decreases. This allows a part of the leaf spring 90 located about the opening 91 to be fitted in the groove 55 of the slide rod 56.

With the frame yoke-type sprinkler head thus assembled, the fusible alloy 65 is urged by the leaf spring 90 through the valve seat 67 and the plunger 66.

Operation of the frame yoke-type sprinkler head is as follows. In the event of fire, the plunger 66 is urged toward the bottom of the cylinder 64 under the spring force of the leaf spring 90 to cause the fusible alloy 65 to flow out of the cylinder 64. The leaf spring 90 is then returned to its original shape or to a frustoconical shape as shown in FIG. 11. This results in an increase in the diameter of the opening 91. As the opening 91 is widened, the slide rod 56 is disengaged from the groove 55. This disengagement permits downward sliding movement of the valve body 57 along the slide rod 56 since the compression spring 68 urges the retainer 63 in a downward direction. Consequently, the valve body 57, the retainer 63 threaded to the valve body 57, the cylinder 64 fitted in the retainer, the plunger 66 located on the cylinder, the valve seat 67 and the leaf spring 90 as a unit drop as shown in FIG. 9.

Upon separation of the valve body 57 from the nozzle 36, water flows out of the nozzle and is then spread or sprayed under the influence of the deflectors 33 so as to extinguish the fore.

The present invention allows a flush-type sprinkler head to employ either of the thermally responsive units in the previous embodiments. Thus, such a flush-type sprinkler head will not be described herein.

In the illustrated embodiments, the leaf springs are engaged with the guide post of the cover, the nozzle or the slide rod. However, the invention is not limited thereto. The leaf springs may alternatively be engaged with any other part of the sprinkler head.

With the sprinkler head of the present invention as thus far described, the leaf spring is employed to bear the force of the valve body. In addition the periphery of the leaf spring is engaged with the structural part of the sprinkler head. This arrangement holds the thermally responsive unit against loosening or breakage which may occur when external forces are applied thereto. Thus, the sprinkler head of the present invention is more reliable and economical than the prior sprinkler head.

What is claimed is:

1. A sprinkler head comprising:

a nozzle through which water may be discharged to extinguish fire;

a member positionable relative to said nozzle in a closed position closing said nozzle and preventing discharge of water therefrom and movable from said nozzle to an open position allowing discharge of water therefrom;

a leaf spring having an original shape, said leaf spring being deformable from said original shape and being resiliently returnable to said original shape;

a thermally responsive element positioned to prevent said leaf spring from returning to said original shape;

said leaf spring holding said member in said closed position by application to said leaf spring of a force to deform said leaf spring from said original shape in an axial direction of said sprinkler head and in a direction substantially perpendicular to said axial direction; and whereby upon removal of said force, said leaf spring is returnable to said original shape to thereby release said member from said closed position.

2. The sprinkler head of claim 1, further comprising:

a structural part through which said nozzle is formed; and wherein said spring leaf comprises an inner portion and an outer portion, said outer portion being engageable with said structural part to position said member in said closed position.

3. The sprinkler head of claim 2, wherein:

said outer portion has a greater mechanical strength than said inner portion.

4. The sprinkler head of claim 2, wherein:

said outer portion is wider than said inner portion.

5. The sprinkler head of claim 2, wherein:

said outer portion is thicker than said inner portion.

6. The sprinkler head of claim 1, further comprising:

a structural part through which said nozzle is formed;

wherein said spring leaf is engageable with said structural part to position said member in said closed position; and wherein upon removal of said force, said leaf spring is returnable to said original shape thus disengaging from said structural part and thereby moving said member to said open position to discharge water.

7. The sprinkler head of claim 1, wherein:

said thermally responsive element has a predetermined melting point.

8. The sprinkler head of claim 1, wherein said leaf spring comprises:

a central portion; and a plurality of locking elements extending radially outwardly from said central portion.

9. The sprinkler head of claim 1, wherein:

said leaf spring has a frustoconical shape and comprises a central opening, a plurality of substantially V-shaped outer recesses, and a plurality of substantially U-shaped inner recesses; and said plurality of substantially V-shaped outer recesses and said plurality of substantially U-shaped inner recesses are alternately arranged around said central opening.

10. The sprinkler head of claim 1, wherein said leaf spring comprises:

a rectangular plate having opposite ends; and two locking elements extending outwardly from said opposite ends of said rectangular plate.

11. The sprinkler head of claim 1, wherein:

said leaf spring is disposed within said nozzle.

* * * * *